United States Patent [19]

Koppensteiner

[11] 4,156,218

[45] May 22, 1979

[54] RETAINING MEANS FOR SECURING A BIASING MAGNET IN A REED RELAY SWITCHING ASSEMBLY

[75] Inventor: James V. Koppensteiner, Chicago, Ill.

[73] Assignee: GTE Automatic Electric Laboratories Incorporated, Northlake, Ill.

[21] Appl. No.: 879,320

[22] Filed: Feb. 21, 1978

[51] Int. Cl.[2] ..... H01H 51/29

[52] U.S. Cl. ..... 335/153; 335/152; 335/202

[58] Field of Search ..... 335/153, 152, 151, 154, 335/202

[56] References Cited

U.S. PATENT DOCUMENTS

| | | | |
|---|---|---|---|
| 3,188,425 | 6/1965 | Henquet et al. | 335/153 |
| 3,222,758 | 12/1965 | Marks | 335/153 |
| 3,237,096 | 2/1966 | Zechman | 335/153 |

*Primary Examiner*—Harold Broome

[57] ABSTRACT

A molded plastic retainer for securing a permanent biasing magnet in position inside the core of a multi-capsule reed relay assembly, wherein the retainer secures the magnet by an interference fit between the magnet and an inner core wall. The retainer includes fins which position the reed capsules against the magnet.

7 Claims, 5 Drawing Figures

RETAINING MEANS FOR SECURING A BIASING MAGNET IN A REED RELAY SWITCHING ASSEMBLY

BACKGROUND OF THE INVENTION

1. Field of the Invention

This invention relates in general to multi-capsule reed relay assemblies employing a permanent biasing magnet and more particularly to a device for securing the biasing magnet.

2. Description of the Prior Art

Reed contact relays presently known, equipped with a permanent biasing magnet are operated by a coil excited by an opposite polarity to the permanent biasing magnet, which, either makes or breaks the contacts. With these known arrangements the reed contacts and the permanent biasing magnet are accommodated within the exciter coil and are encircled by the coil. Typically, reed contacts and a permanent biasing magnet are inserted individually into the relay and fixed within the coil body. Currently, several methods are employed for fixing or securing the permanent biasing magnet.

One method used, is to secure the permanent magnet by applying epoxy resin cement to the magnet and reed capsules and permanently fixing them to each other as taught by U.S. Pat. Nos. 3,222,758 and 3,237,096. This arrangement has considerable drawbacks because the glass envelopes of the reed capsules and the permanent magnet have different heat expansion coefficients, which, thru excessive heat and humidity as experienced during storage and shipment, cracks the envelopes or adversely effects the adhesive. This causes either the reed contacts to become useless, or through rough handling loosens the magnet. Such changes cause the established values of the permanent magnet to change and consequently, the pull-up and drop values of the reed contacts to the permanent magnet are outside the required tolerances.

Still another method used, is to manufacture the reed capsules and the permanent biasing magnet within a poured resin block as a complete unit, then inserting the block into the coil body as taught by U.S. Pat. No. 3,284,738. The disadvantages to this method are that in an event where one of the reed capsules becomes inoperative the complete unit must be replaced thus discarding the associated components which are operative. Ultimately, this is wasteful of material and labor used to manufacture these units.

Accordingly, it is the object of the present invention to provide a simple, effective, one-piece device for securing the permanent biasing magnet within a multi-capsule reed relay assembly.

SUMMARY OF THE INVENTION

In accomplishing the object of the present invention, there is provided as the environment, a multi-capsule reed relay assembly of the type to which the invention is applied. The reed relay assembly includes, a vertically oriented tubular bobbin with a core arranged in an open type bore including four parallel circular channels in a cloverleaf configuration. A pair of glass encapsulated reed switches are installed opposite of each other, each within a corresponding channel, a cylindrical permanent biasing magnet is placed in a channel adjacent to both reed switches and the retainer in the fourth channel.

The retainer, in accordance with the present invention, is composed of a one-piece unitary structure of molded resilient plastic and consists of a tubular shaft having a portion of the shaft cut away in the form of a split. A longitudinally oriented rib is positioned directly opposite the split, along the exterior of the shaft. The rib includes a front surface which is generally concave in cross section, a bottom end surface having a truncated portion and a top end surface where a finger like stop element is arranged outward and perpendicular to the rib. A pair of longitudinally oriented fin members, one on each side of the shaft project outward and perpendicular to the rib.

The retainer, of the present invention, is typically installed in the following manner: The retainers tubular shaft is inserted into a circular channel adjacent to the pair of reed switches and directly opposite of the permanent biasing magnet. The concave surface of the rib engages the permanent magnet along the magnets length and provides for an interference fit between the permanent magnet and the inner channel walls. The truncated portion at the bottom end surface of the rib aids in inserting the retainer. As the retainer is inserted in fin members press against the glass envelopes of the reed switches displacing the reed capsules to physically touch the magnet. When completely inserted the finger like stop element at the top end surface of the rib bears against the top of the permanent magnet and provides for vertical retension. The split down the length of the retainer is designed to allow insertion of the retainer under worse case tolerance distribution of the mating parts.

With the retainer fully seated it is still possible to extract each reed capsule from the assembly thus being able to replace these components without having to dispose of the whole unit. Similarly, the retainer may be extracted from the bore making it possible to replace defective magnets.

BRIEF DESCRIPTION OF THE DRAWINGS

A better understanding of the invention may be had from a consideration of the following detailed description taken in conjunction with the accompanying drawings in which.

PREFERRED EMBODIMENT OF THE INVENTION

Figure 1:
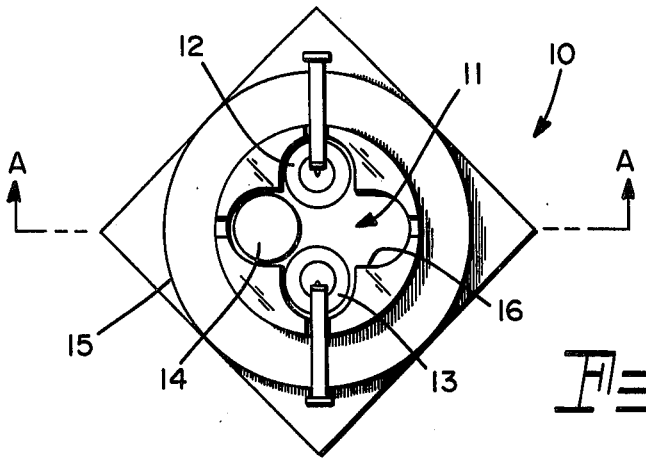
FIG. 1 is a top plan view, of a multi-capsule reed relay switching assembly of the type to which the present invention is applied.
Figure 2:
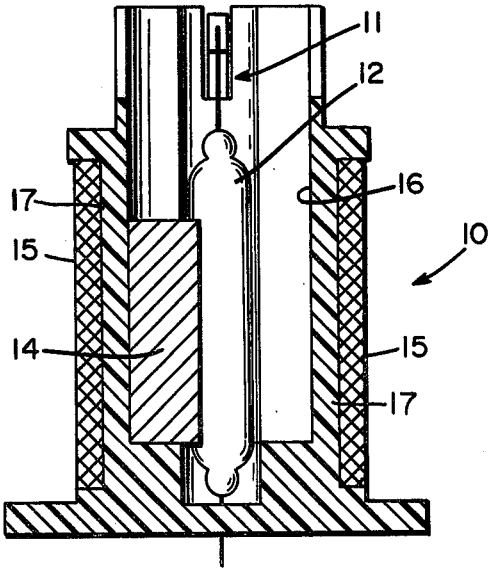
FIG. 2 is a cross-section view of the multi-capsule reed relay assembly shown in FIG. 1 and taken substantially along line A—A.

Referring now to the accompanying drawings of the present invention, FIG. 1 and FIG. 2, illustrates a multi-capsule reed relay switching assembly 10 of the type to which the invention is applied. It should be understood that the reed relay switching assembly 10 illustrates the functional environment in this embodiment and forms no part of the invention. The reed relay assembly 10 includes an energizing coil denoted by character 15, which is wound on a bobbin or tubular section 17 made of an insulating material. A central core 11 is arranged in an open type bore with four parallel circular channels in a clover-leaf configuration. Each circular channel, includes inner channel walls identical to that shown as 16. A pair of glass encapsulated reed switches 12 and 13 are installed opposite of each other and each within a corresponding channel. A permanent biasing magnet 14 is placed in the channel adjacent to both reed switches 12 and 13.

Figure 3:
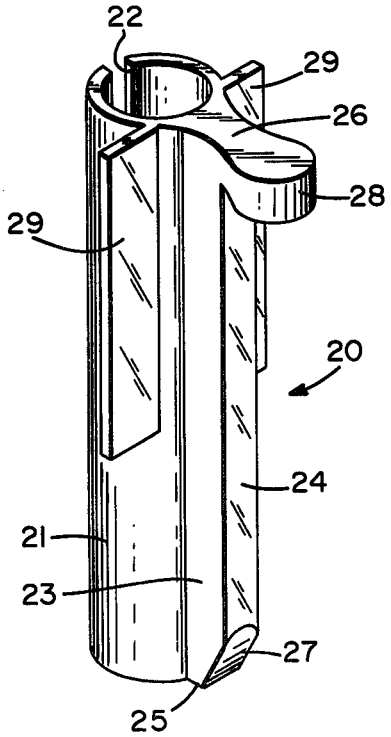
FIG. 3 is a detailed perspective view of the permanent biasing magnet retainer in accordance with the present invention described herein.

Referring now to FIG. 3, a permanent biasing magnet retainer in accordance with the principles of this invention is illustrated. The retainer 20 is composed as a one-piece unitary structure of molded resilient plastic and includes a tubular shaft 21 having a portion of the shaft 21 cut away along its longitudinal length to form a split 22. A rib 23 is longitudinally oriented along the exterior of the tubular shaft 21 and projects outward and perpendicular to the shaft 21, directly opposite of the split 22. The rib 23 includes a front surface 24 generally concave in cross-section arranged to follow a portion of the circular exterior surface of the magnet. Rib 23 further includes, a top end portion 26 having a stop element 28, arranged outwardly and perpendicular to rib 23 and a truncated surface 27 longitudinally oriented between a portion of the front surface 24 and a portion of a bottom surface 25. A pair of longitudinally oriented fin members 29 are arranged opposite of each other in a common plane, outwardly of the tubular shaft 21 and each perpendicular to rib 23.

Figure 4:
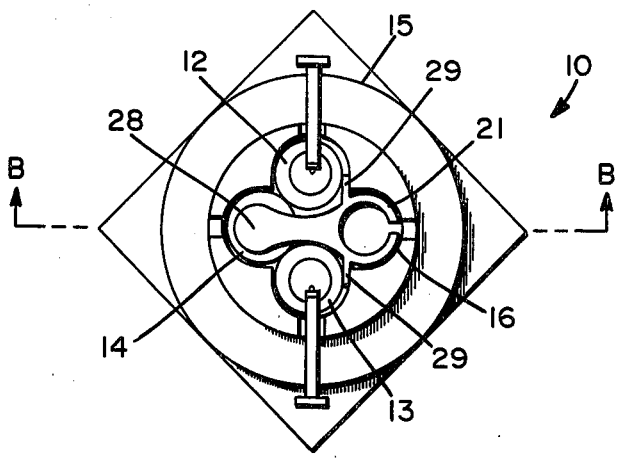
FIG. 4 is a top plan view, of a multi-capsule reed relay switching assembly using the permanent biasing magnet retainer in accordance with the present invention.
Figure 5:
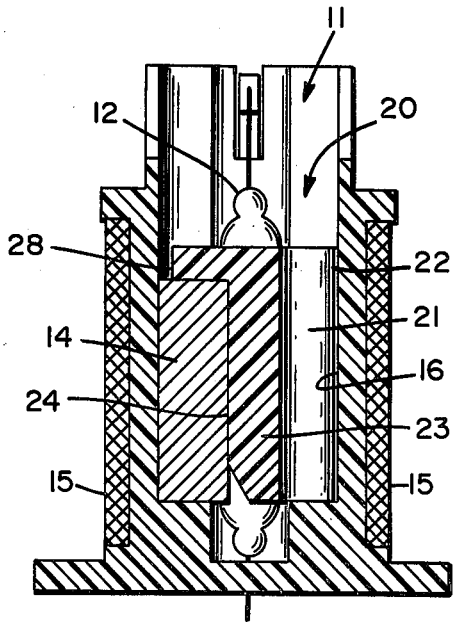
FIG. 5 is a cross-section view of the multi-capsule reed relay assembly shown in FIG. 4 and taken substantially along line B—B.

Referring now to FIG. 4 and FIG. 5, the installation of the permanent biasing magnet retainer of the present invention is illustrated. The retainers tubular shaft 21 is inserted into a circular channel communicating with the corresponding inner channel walls 16, adjacent to reed relay switches 12, 13 and directly opposite of the permanent biasing magnet 14. The front surface 24 of rib 23 engages the permanent magnet 14 along the magnets longitudinal length and provides for an interference fit between the magnet 14 and the inner channel walls 16. The truncated portion 27 at the bottom end of the rib 23 is arranged to ease the insertion of the retainer 20 against the magnet. As the retainer is inserted, the fin members 29 are arranged to fit between the exterior glass envelopes of reed switches 12 and 13 and inner channel walls 16 displacing the reed capsules 12 and 13 to physically touch the permanent biasing magnet 14. When the retainer 20 is completely inserted the finger like stop element 28 engages against the top of the magnet 14 and provides for vertical retention of the magnet. The split 22 along the longitudinal length of the tubular shaft 21 is designed to allow insertion of the retainer under worse case tolerance distribution of the mating parts.

Since the retainer 20 when fully seated does not bear against the top of the reed switches 12 and 13 it is possible to extract these components without having to disassemble the whole unit. Similarly, the retainer 20 may be extracted from the bore 11 making it possible to replace defective magnets and since no adhesive is required the retainer 20 may be installed or extracted as many times as needed.

The present invention has been described with reference to a specific embodiment thereof, for the purpose of illustrating the manner in which the invention may be used to advantage, it will be appreciated by those skilled in the art that the invention is not limited thereto. Accordingly, any and all modifications, variations or equivalent arrangements which may occur to those skilled in the art should be considered to be within the scope of the invention.

What is claimed is:

1. Retaining means for a reed relay switching assembly including four parallel channels longitudinally oriented within a central portion of an included bobbin, a pair of glass encapsulated reed switches, a first reed switch of said pair of reed switches positioned within a first channel, and a second reed switch of said pair of reed switches positioned within a second channel, said second reed switch parallel and in direct opposition to said first reed switch, a magnet including a top surface, positioned within a third channel adjacent to and in communication with said pair of reed switches, said retaining means adapted to fixedly retain said magnet in position; said retaining means comprising;

a cylindrical shaft adapted to be inserted within a fourth channel adjacent to said pair of reed switches; and a longitudinally oriented rib having a front surface and top and bottom end surfaces, said rib arranged perpendicular to the exterior of said cylindrical shaft with said front surface disposed to be longitudinally urged against said magnet.

2. Retaining means as recited in claim 1, wherein: said retaining means is composed of a resilient material as a one-piece unitary structure.

3. Retaining means as recited in claim 1, wherein: said cylindrical shaft includes a longitudinally oriented bore within a central portion of said shaft and a longitudinal split directly opposite of said rib, adapted to provide a frictional fit and to allow insertion of said shaft into said fourth channel.

4. Retaining means as recited in claim 1, wherein: said front surface of said rib is generally concave in cross section.

5. Retaining means as recited in claim 1, wherein: said rib includes a truncated surface longitudinally oriented between a portion of said bottom end surface and said front surface disposed to ease the insertion of said retainer against said magnet.

6. Retaining means as recited in claim 1, wherein: said cylindrical shaft further includes a pair of longitudinally oriented fin members, each fin member of said pair of fin members arranged outwardly from said cylindrical shaft directly opposite of each other and perpendicular to said rib, said pair of fin members adapted to each press against one of said pair of reed switches and arranged to position said reed switches against said magnet.

7. Retaining means as recited in claim 1, wherein: a stop element is arranged perpendicular to said top end surface of said rib and adapted to engage said top surface of said magnet.

* * * * *